US006155833A

United States Patent [19]

Lenihan

[11] Patent Number: 6,155,833

[45] Date of Patent: Dec. 5, 2000

[54] RIDE SIMULATOR FOR USE WITH A CHILDREN'S RIDE-ON VEHICLE

[75] Inventor: Gary G. Lenihan, East Aurora, N.Y.

[73] Assignee: Mattel, Inc., El Segundo, Calif.

[21] Appl. No.: 09/354,939

[22] Filed: Jul. 15, 1999

Related U.S. Application Data

[63] Continuation of application No. 08/769,372, Dec. 19, 1996, Pat. No. 5,947,739.

[51] Int. Cl.[7] ..... A63H 17/00

[52] U.S. Cl. ..... 434/29; 434/66; 434/67; 482/61; 446/437

[58] Field of Search ..... 434/29, 61, 62, 434/66, 67; 446/429, 437, 440, 441, 466; 482/57, 61, 51

[56] References Cited

U.S. PATENT DOCUMENTS

| | | | |
|---|---|---|---|
| 2,261,846 | 11/1941 | Dollinger . | |
| 2,872,191 | 2/1959 | Gallo, Sr. . | |
| 3,432,164 | 3/1969 | Deeks . | |
| 3,686,776 | 8/1972 | Dahl . | |
| 3,762,703 | 10/1973 | Gibbs . | |
| 3,866,908 | 2/1975 | Hangler | 982/61 |
| 4,049,262 | 9/1977 | Cunningham, Jr. . | |
| 4,214,381 | 7/1980 | Clark et al. . | |
| 4,932,651 | 6/1990 | Defaux . | |
| 4,958,832 | 9/1990 | Kim . | |
| 5,346,398 | 9/1994 | Nakahata et al. . | |

*Primary Examiner*—John Mulcahy
*Attorney, Agent, or Firm*—Kolisch, Hartwell, Dickinson, McCormack & Heuser

[57] ABSTRACT

A ride simulator for use with a children's ride-on vehicle. The simulator includes a base, and a mechanism for removably securing to at least one of the wheels of an independently operable children's ride-on vehicle. The mechanism includes a fastener that selectively engages a mount on the wheel to support the wheel and at least a portion of the vehicle above the base. Driven rotation of the wheel to which the fastener is engaged causes reciprocating horizontal and vertical motion of the vehicle with respect to the base, thereby simulating ground-traveling movement of the vehicle.

29 Claims, 5 Drawing Sheets

RIDE SIMULATOR FOR USE WITH A CHILDREN'S RIDE-ON VEHICLE

CROSS REFERENCE TO RELATED APPLICATIONS

This application is a continuation of and claims priority to U.S. patent application Ser. No. 08/769,372, filed Dec. 19, 1996 now U.S. Pat. No. 5,947,739, the disclosure of which is hereby incorporated by reference.

BACKGROUND AND SUMMARY OF THE INVENTION

The present invention relates generally to children's ride-on vehicles. More specifically, the invention concerns a ride simulator for a children's ride-on vehicle. The simulator maintains the vehicle in a supported, localized position and simulates ground-traveling movement by horizontally and vertically moving the vehicle along a defined path.

Children's ride-on vehicles come in many different shapes and sizes to accommodate children of different ages and sizes. Typically the vehicles are motorized, with a battery source connected to an electric motor that drives one or more of the vehicle's wheels according to the speed and direction selected by the child.

To operate the vehicle, a child will sit on or within the vehicle, and by pressing a pedal or moving a switch or button on a control panel, the vehicle's motor is energized by the battery source. The child then drives the vehicle in much the same way as an adult operates an automobile. In addition, most vehicles have more than one speed, and several have more than one direction. In vehicles having more than one speed, there is usually a high and a low speed. In vehicles having more than one direction, the second direction is usually reverse.

When a child, and especially a young child, is first learning to operate a motorized ride-on vehicle, the child is often unaccustomed to controlling and steering the vehicle. As a result, the child may be injured, as well as cause damage to the vehicle or other objects, as the child learns to maneuver and control the vehicle. Parents also want to let their children enjoy a ride-on vehicle at a very young age without allowing the vehicle to be actually driven. In addition, very young children often want to use a ride-on vehicle, but lack the strength and coordination necessary to control and operate the vehicle. This can be particularly troublesome when a child has older siblings that are able to play with and enjoy a ride-on vehicle.

With the above problems in mind, a general object of the present invention is to provide a ride simulator for use with a children's ride-on vehicle. The simulator removably supports the vehicle and simulates ground-traveling movement of the vehicle by moving the vehicle in a reciprocating path of horizontal and vertical movements about a defined location on the simulator. The simulator allows a child to become accustomed to the controls and motions associated with operating a motorized ride-on vehicle, while maintaining the vehicle in a localized, supported position.

It is another object of the invention to provide a ride simulator for an independently operable children's ride-on vehicle that enables the vehicle to be mounted on the simulator to simulate ground-traveling movement, or to be removed from and used independently of the simulator.

Still another object of the invention is to provide a ride simulator that is rugged enough to tolerate the abuses expected in the operating environment, yet is economical to manufacture by virtue of having relatively few parts, featuring components readily moldable from plastic, and not requiring precisely fitting parts.

The invention achieves these and other objects in the form of a ride simulator having a base, and a mechanism for removably securing to at least one of the wheels of an independently operable children's ride-on vehicle. The mechanism includes a fastener that selectively engages a mount on the wheel to support the wheel and at least a portion of the vehicle above the base. Driven rotation of the wheel to which the fastener is engaged causes reciprocating horizontal and vertical motion of the vehicle with respect to the base, thereby simulating ground-traveling movement of the vehicle.

These and other objects and advantages are obtained by the invention, which is described below in conjunction with the accompanying drawings.

DETAILED DESCRIPTION OF THE PREFERRED EMBODIMENTS

Figure 1:
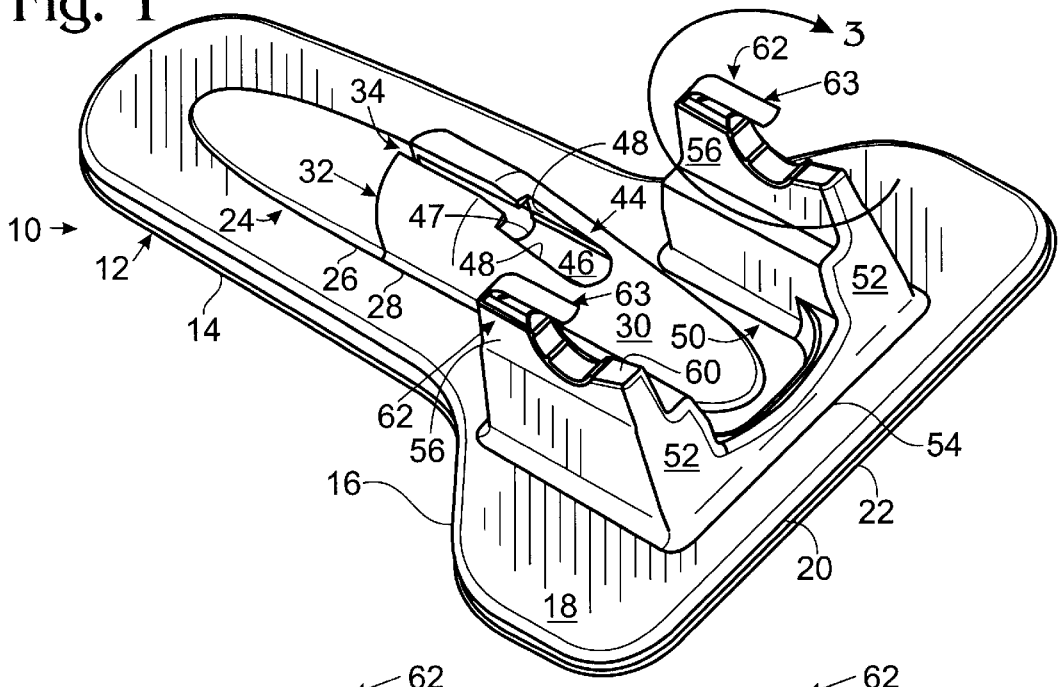
FIG. 1 is an isometric view of a simulator for a children's ride-on vehicle.

A ride simulator constructed according to the present invention is shown in FIG. 1 and is generally indicated at 10. The simulator has a stationary base 12, which has a generally T-shaped configuration with an elongate front portion 14 that extends into a wider rear portion 16. Base 12 includes a generally planar surface 18 with a side wall 20 extending downwardly from the surface's perimeter. Side wall 20 terminates at a peripheral flange 22 that provides support and stability to the simulator 10.

A first support structure 24 extends upwardly from base 12 for removably engaging and slidably supporting at least a first portion, and preferably a forward portion, of a children's ride-on vehicle above base 12 in a manner to be described subsequently. As shown, first support structure 24 is centrally located on surface 18 and includes a forward region 26, a central platform 28, and a rearward region 30. The forward and rearward regions are generally tapered toward base 12 as they extend away from platform 28 and provide stability and increased support to the simulator, and especially the first support structure.

Figure 2:
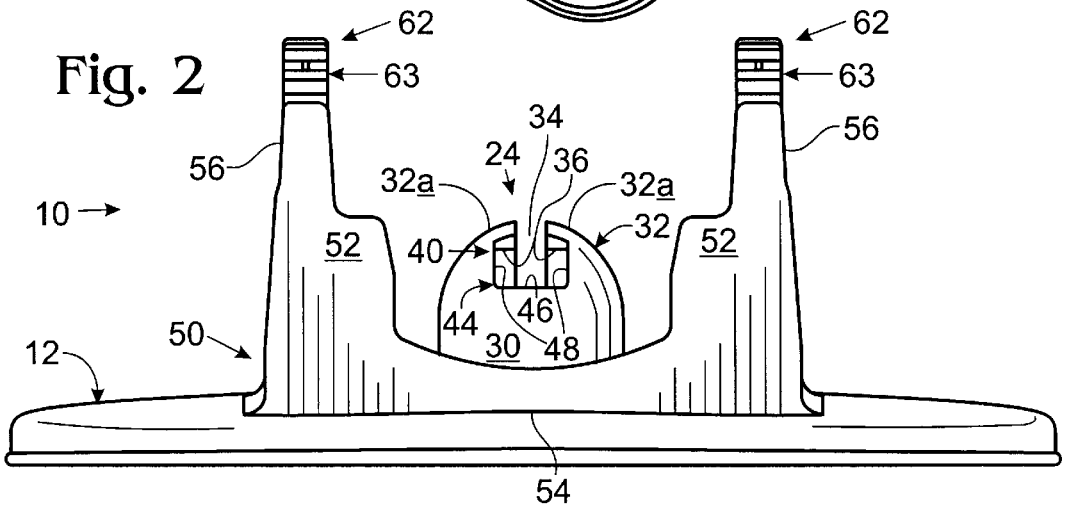
FIG. 2 is a rear view of the simulator of FIG. 1.

The first support structure's central platform 28 has a top portion 32 that defines an elongate slot 34. Slot 34 extends along the top portion in a direction transverse to the base's rear portion. As seen in FIG. 2, top portion 32 has a generally arcuate cross-sectional configuration and includes a pair of opposed members 32*a* that curve inwardly toward each other to define slot 34. Members 32*a* further define a slide plane 36 that is beneath top portion 32 and generally parallel to slot 34. Top portion 28, slot 34 and slide plane 36 may be collectively thought of as a track into which at the forward portion of the frame may be slidably received. The track is generally indicated at 40 in FIG. 2.

The first support structure's rearward region 30 extends away from track 40 in the direction of the rear portion of the simulator. Rearward region 30 has a generally arcuate cross-sectional configuration, as seen in FIGS. 1–2, and extends at an incline between the first support structure's top portion 32 and base 12. Rearward region 30 includes a landing 44 adjacent the rear portion of track 40. Landing 44 is disposed above base 12, yet below track 40, and includes a generally planar surface 46 with opposed side walls 48. As shown in FIG. 1, the front portion 47 of surface 46 is recessed to provide an enlarged entry into track 40. The landing provides a surface on which the forward portion of the vehicle's frame may be initially rested and positioned prior to insertion into the track. This 20 enables the frame to be properly aligned with track 40 before it is slidably received into the track.

The simulator further includes a mechanism adapted to be coupled to the vehicle to effect reciprocating horizontal and vertical movement of the vehicle about a defined location on the simulator upon rotation of the vehicle's drive assembly, thereby simulating ground-traveling movement of the vehicle. The mechanism is connected to the simulator and causes the vehicle to move horizontally and vertically about a defined path when motion is imparted to the vehicle. Typically, the vehicle includes a drive assembly that includes an axle and at least one driven wheel and that receives power from the vehicle's battery source and propels the vehicle in a selected direction. The mechanism includes an actuator that is removably coupled to the drive assembly or other source of ground-traveling movement and causes the vehicle's reciprocating movement. Therefore, even though the actuator does not require its own power source, it causes the vehicle to move along a horizontal and vertical path by coupling to the vehicle's axle or other source of ground-traveling movement, such as the vehicle's wheels or motor source.

Preferably, the mechanism includes a cam mounted on the axle along an axis laterally offset from, and generally parallel to, the axle's longitudinal axis. When the vehicle includes a cam, the actuator is configured to receive the cam and to cause the reciprocating motion of the vehicle when the cam is rotated about the axle. Because the cam is mounted on the axle along an axis that is offset from the axle's longitudinal axis, the dual engagement of the cam by the actuator and the axle causes the entire vehicle to reciprocate along a horizontal and vertical path as the cam rotates about the axle. When the vehicle includes a pair of cams, the simulator may include a pair of actuators, each configured to removably receive and support one of the cams.

As seen in FIGS. 1 and 2, a second support structure 50 extends upwardly from the rear portion 16 of base 12. Second support structure 50 includes a pair of spaced-apart mounts 52 that extend upwardly from the base adjacent opposite sides of the first support structure's rearward portion. The mounts are joined by an elongate rib 54 that provides additional support and stability. As shown, each mount 52 includes an upper portion 56 that is configured to receive and support a rearward portion of the vehicle. The top surface of each upper portion 56 is best seen in FIG. 3 and includes a forward region 58, which is generally parallel to base 12, followed by a trough-like arcuate region 59 into which the vehicle's rearward portion is seated, and ending with an upwardly inclined region 60 that guides the rearward portion of the vehicle into the arcuate region.

As shown in FIGS. 1–2, simulator 10 further includes a pair of actuators 62 that are configured to be coupled to the vehicle to effect reciprocating horizontal and vertical motion of the vehicle about a defined location on the simulator to simulate ground-traveling movement of the vehicle. Each simulator is mounted on the upper portion 56 of one of the mounts and is configured to receive and support a rearward portion of the vehicle.

Figure 3:
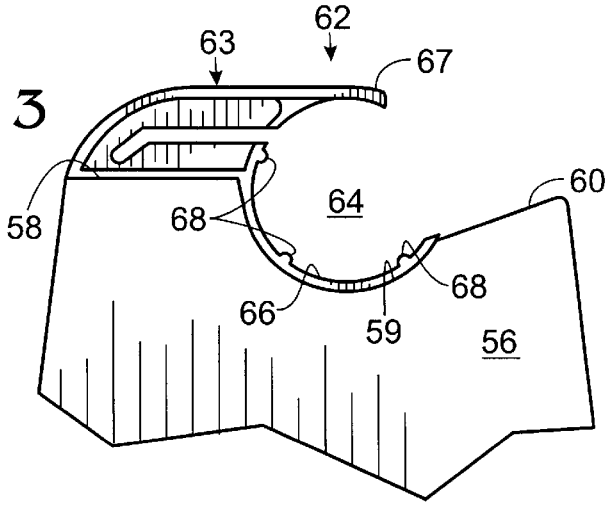
FIG. 3 is an enlarged detail taken along curved line 3 in FIG. 1, showing one of the simulator's actuators.

As seen in FIG. 3, each actuator 62 includes a clip 63 with a lower surface that generally conforms to the shape of the top surface of upper portion 56. Clip 63 defines a recess 64 into which the rearward portion of the vehicle is received and supported. Clip 63 includes a race 66 that provides a guide for the received portion of the vehicle as it rotates within the clip. A resilient shoulder 67 is attached to clip 63 distal race 66. Shoulder 67 extends upwardly above the clip to form at least a portion of the race. Clip 63 further includes a plurality of ribs 68 that are spaced apart on race 66 and extend transverse to the race. Ribs 68 are configured to engage the rearward portion of the vehicle when it is inserted into the clip. The ribs reduce the friction between the portion of the vehicle and each clip, thereby reducing the amount of force necessary to cause the portion to rotate within each clip.

It should be understood that the second support structure could include a single mount with an upper portion that includes the previously described actuator or pair of spaced-apart actuators. In addition, actuator 50 should not be limited to the embodiments described above. Other actuators are possible and are intended to be within the scope of the invention, as long as they are configured to be coupled to the vehicle to effect reciprocating horizontal and vertical motion of the vehicle. For example, the actuator may be a cam that is rotatably mounted on the simulator about an axis that is offset from the cam's longitudinal axis. In that embodiment, the cam engages a portion of the vehicle, such as the vehicle's axle or wheels, and effects the reciprocating motion of the vehicle when motion is imparted to the axle or wheels from the vehicle's power source.

Simulator 10 is constructed of a durable structural material that is capable of supporting the weight of a children's ride-on vehicle and a child. An example of a suitable material is molded plastic. Furthermore, the entire simulator may be formed in a single unitary component, however, in the preferred embodiment, the clips are formed independent of the rest of the simulator and are mounted on the upper portions of the second support structure's walls with a suitable mounting device, such as adhesive or screws.

Figure 4:
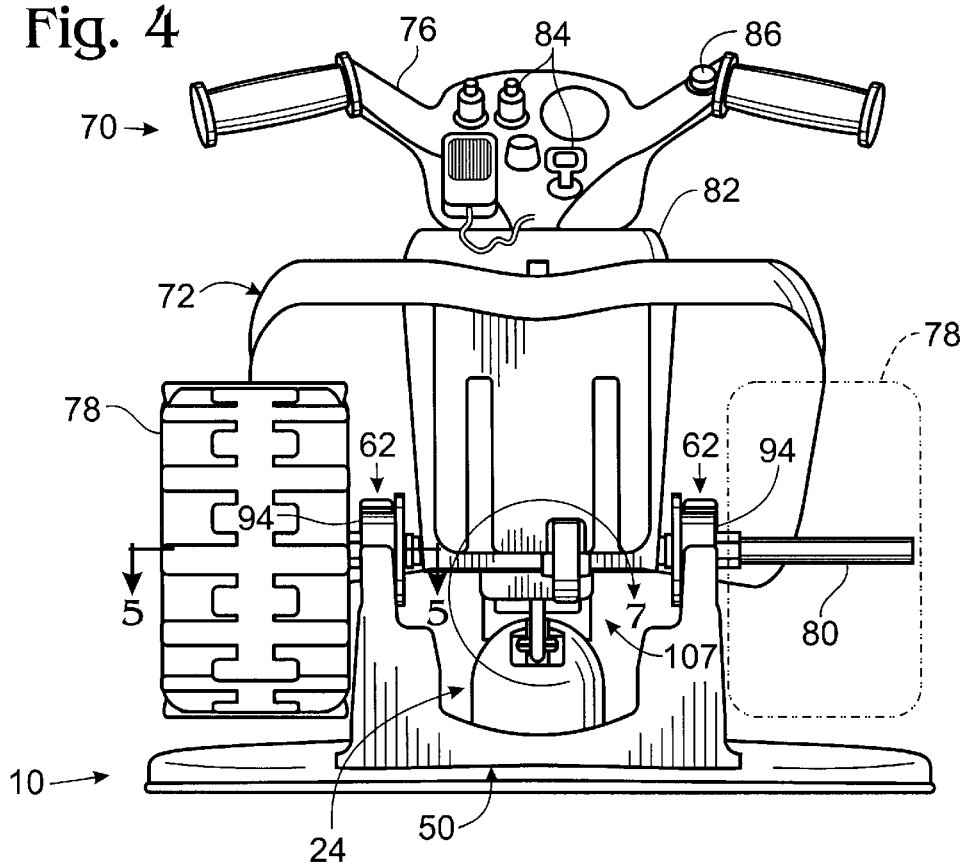
FIG. 4 is a rear view of the simulator of FIG. 1 with a children's ride-on vehicle mounted on the simulator and one of the vehicle's rear wheels removed.

As discussed, the ride simulator is intended for use with a children's ride-on vehicle. Preferably, the vehicle is independently operable so that it may be used apart from the simulator as well as with the simulator. In FIG. 4, an independently operable children's ride-on vehicle is shown mounted on simulator 10. The vehicle is generally indicated at 70 and includes a frame 72, a pair of front wheels (shown in FIG. 10) coupled to a steering mechanism 76, and a pair of rear wheels 78 mounted on the vehicle's rear axle 80. Vehicle 70 further includes a seat 82 on the frame for a child, controls 84 mounted on the steering mechanism and a power switch 86. Power switch 86 is connected to a motor source and a power source, which are housed within the vehicle's frame and which include at least one motor and at least one battery, respectively. The power switch selectively completes a circuit between the motor and the power source to provide power for the vehicle. When the circuit is complete, the motor and power source collectively cause the vehicle's rear axle to rotate, thereby causing the vehicle's rear wheels to rotate. Preferably, the power switch is a button on the steering mechanism, as shown in FIG. 4, or a pedal that resembles a gas pedal on a conventional automobile, although other power switches are possible.

Figure 5:
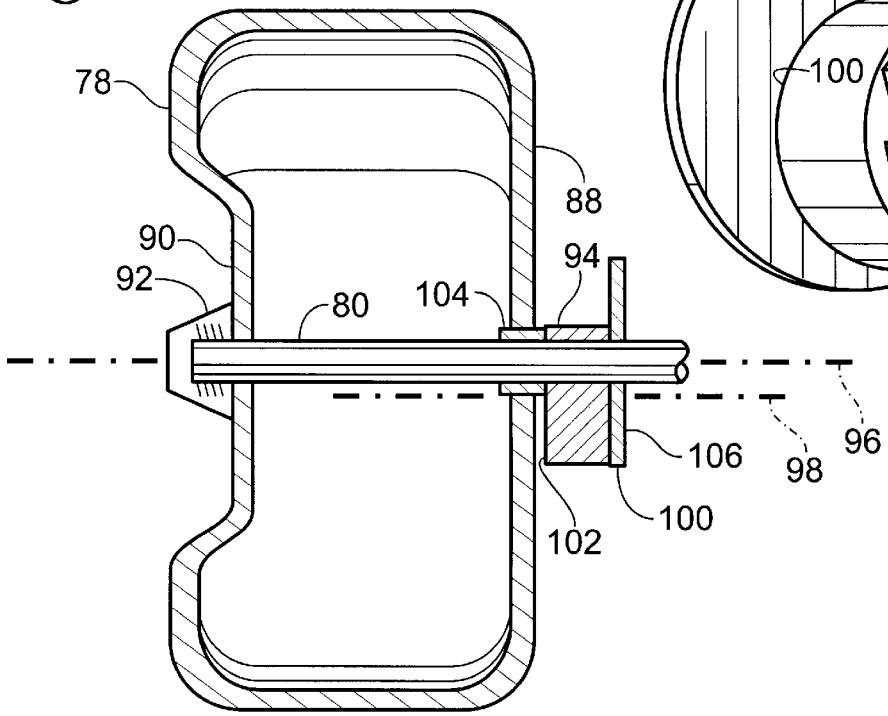
FIG. 5 is a fragmentary cross-sectional view of the vehicle of FIG. 4, taken along line 5—5 in FIG. 4 and showing the vehicle's axle, a cam and a wheel.

Rear wheels 78 are mounted in a spaced-apart relationship along a common axis, namely, the vehicle's rear axle 80. FIG. 5 is a cross-sectional view of the vehicle's left rear wheel. As shown in FIG. 5, wheel 78 is centrally mounted on axle 80. The axle extends through the vehicle's inner and outer walls, 88 and 90, respectively. Wheel 78 is secured on the axle by a clamp 92 that is attached to the end of axle 80. The vehicle's other wheels are similarly mounted on their respective axles.

A pair of cams 94 are mounted on axle 80, as shown in FIG. 4. The cams are mounted in a spaced-apart relationship, one adjacent each of the vehicle's rear wheels. The cams form at least a portion of the previously discussed rearward portion of the vehicle and are received and supported by the upper portions of the second support structure's mounts. Each cam is received within one of the actuators, and specifically within the recess formed by one of the clips. As shown, the cams are maintained within the clips by shoulders 67.

As shown in FIGS. 4–5, cams 94 are mounted on axle 80 along an axis that is parallel to, yet spaced-apart from, the longitudinal axis of the axle. In FIG. 5, the axle's longitudinal axis is indicated with dash-dot line 96, while the cam's axis is indicated by dash-dot line 98. When the cams are received within actuators 62 and rotate about the axle's longitudinal axis, the offset relationship between the axle's axis and the cams' axis causes the entire vehicle to reciprocate vertically and horizontally about a defined location on the simulator. The path along which the vehicle reciprocates is generally defined by the shape of the cam and the actuator.

Figure 6:
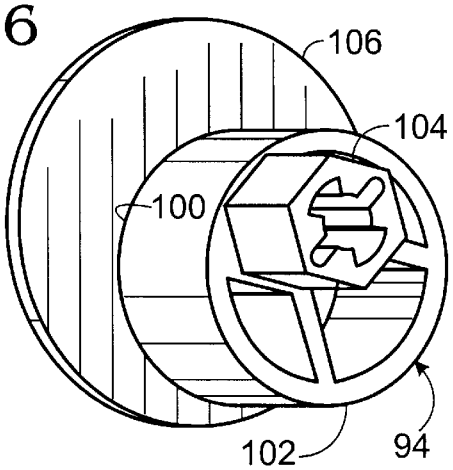
FIG. 6 is an enlarged perspective detail of the cam shown in FIG. 5.

As shown in FIGS. 5 and 6, each cam has a generally cylindrical configuration with opposed inner and outer faces 100 and 102, respectively, through which axle 80 passes. A hexagonal mount 104 is attached to each cam's outer face 102. Mount 104 is inserted into the inner wall of wheel 78 to couple the cam and wheel together. A generally circular disk 106 is mounted on each cam's inner face 100. Disks 106 are positioning guides that maintain the cams in a desired position when engaged by clips 63. It should be understood, however, that other configurations of cams are possible. By varying the shape or size of the cam, for example, it is possible to change the horizontal and vertical path along which the vehicle is moved.

Figure 7:
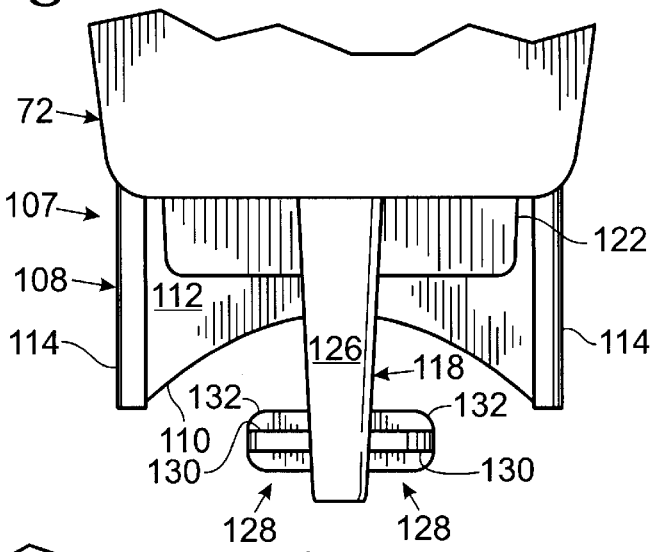
FIG. 7 is a fragmentary rear detail of a portion of the vehicle's frame, taken along the curved line 7 in FIG. 4.
Figure 8:
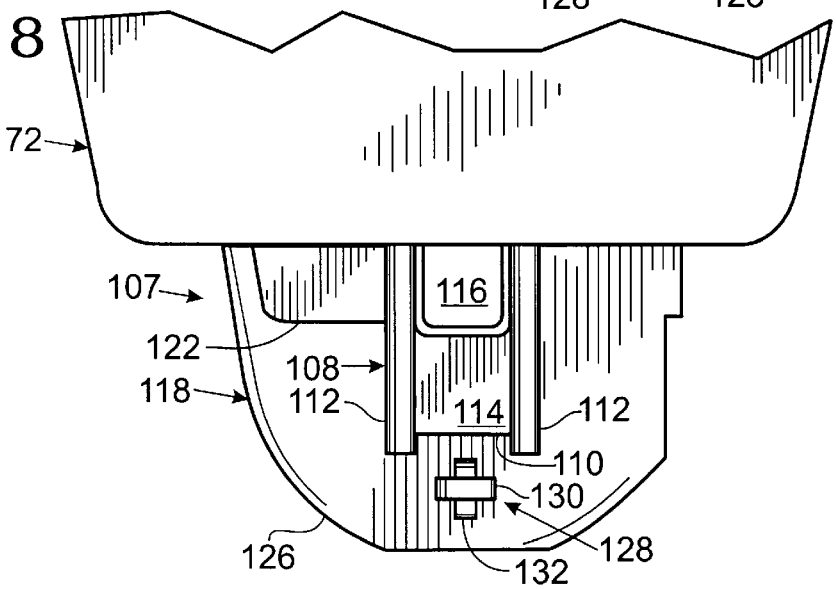
FIG. 8 is a side view of the portion of the vehicle's frame shown in FIG. 7.
Figure 9:
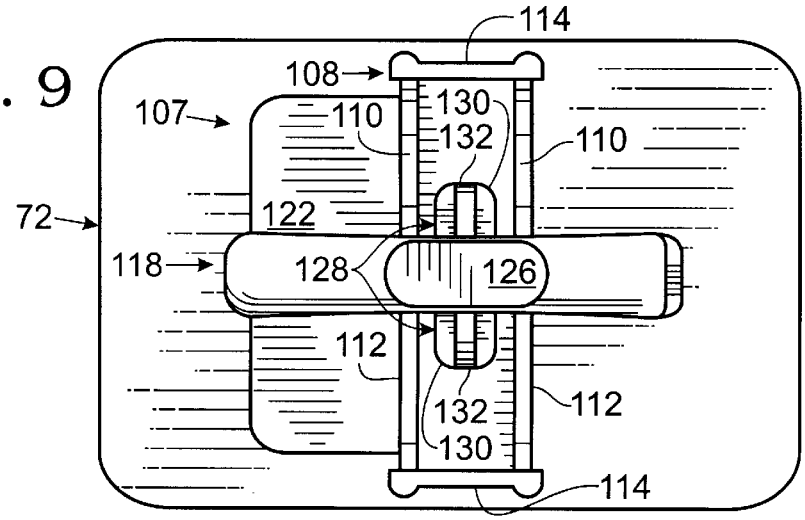
FIG. 9 is a bottom view of the portion of the vehicle's frame shown in FIG. 7.

By referring briefly back to FIG. 4, the reader can see that a central portion 107 of frame 72 is engaged by the first support structure 24. As seen in FIGS. 7–9, central portion 107 includes a slider 108 that extends downwardly from the frame and is configured to engage and slide along the top portion 32 of platform 28. Slider 108 extends in the plane generally parallel to the vehicle's rear axle 80 and has a bottom surface 110 that generally corresponds to the shape of top portion 32. Specifically, slider 108 includes a pair of spaced-apart side walls 112 extending generally parallel to the vehicle's rear axle, and a pair of spaced-apart end walls 114 extending transverse to the side walls. The side walls and end walls collectively form a sturdy box-like structure that extends downwardly from the vehicle's frame 72 to engage and removably slide along platform 28. Side walls 112 have curved lower surfaces that generally correspond to the shape of the platform's top portion. A passage 116 is also shown in FIG. 8. Passage 116 is defined through the slider's end walls and may be used to mount foot rests or other accessories on the vehicle.

Adjacent slider 108, frame 72 includes a downwardly descending portion 118, as shown in FIGS. 7–9. Downwardly descending portion 118 extends in a plane transverse to the slider's side walls 112 and further extends from frame 72 to a centrally-disposed position beneath the slider. A stabilizer 122 is mounted beneath frame 72 adjacent one of the slider's side walls 112 and extends transverse to the downwardly extending portion. Portion 118 has a generally U-shaped configuration, extending downwardly from frame 72 along one of the slider's side walls 114, then further extending toward the front portion of the vehicle and finally returning upwardly to frame 72 along the slider's other side wall 114.

Downwardly descending portion 118 includes a bottom region 126 that is configured to be received into track 40. Bottom region 126 further includes a pair of opposed tabs 128, one extending on each side of the bottom region generally toward one of the slider's end walls 114. As shown, each 128 includes interlocked horizontal and vertical members 130 and 132, respectively. When bottom region 126 is inserted into the simulator's track, tabs 128 are received within track 40 and are slidable along slide plane 36. Once inserted into the track, the tabs, which extend outwardly from region 126 beyond the edges of slot 34, retain the forward portion of the frame on the first support structure, as seen in FIG. 4. The tabs cannot be removed from the track except through the track's rear portion, adjacent landing 46.

Figure 10:
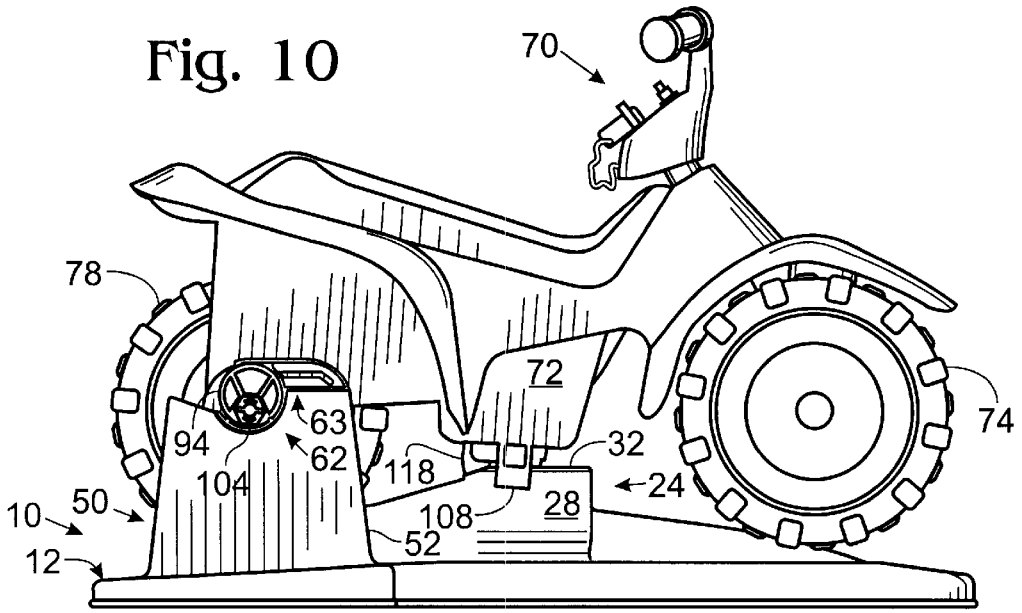
FIG. 10 is a side view of the simulator and vehicle shown in FIG. 4.

In FIG. 10, vehicle 70 is mounted on simulator 10. As shown, cams 94 are received within clips 63, the top portion 32 of platform 28 is engaged by slider 108, and downwardly descending portion 118 is received within the track. As shown, the first and second support structures 24, 50 collectively support the entire vehicle above base 12. Specifically, mounts 52 and clips 63 receive and support cams 94, and thereby support the rearward portion of the vehicle above base 12, and platform 28 receives and supports downwardly descending portion 118 and slider 108, and thereby supports the central and forward portions of the vehicle above base 12.

Figure 11:
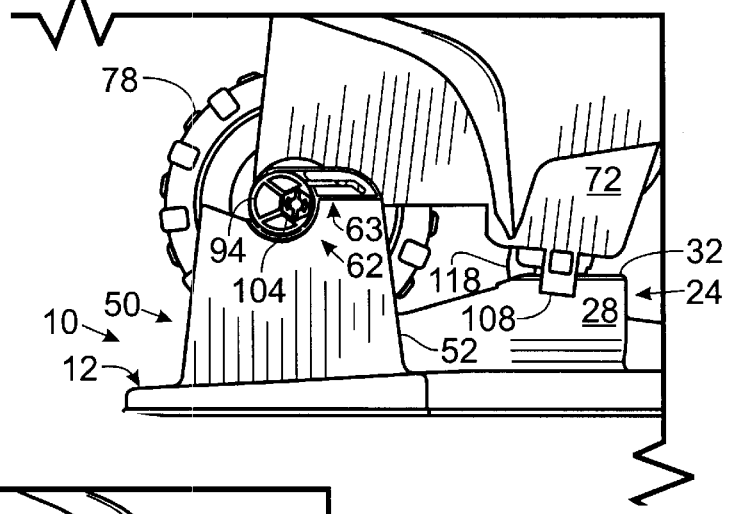
FIGS. 11–12 are fragmentary side views of the simulator and vehicle shown in FIG. 10, with the vehicle moved along its reciprocating horizontal and vertical path about a defined location on the simulator.
Figure 12:
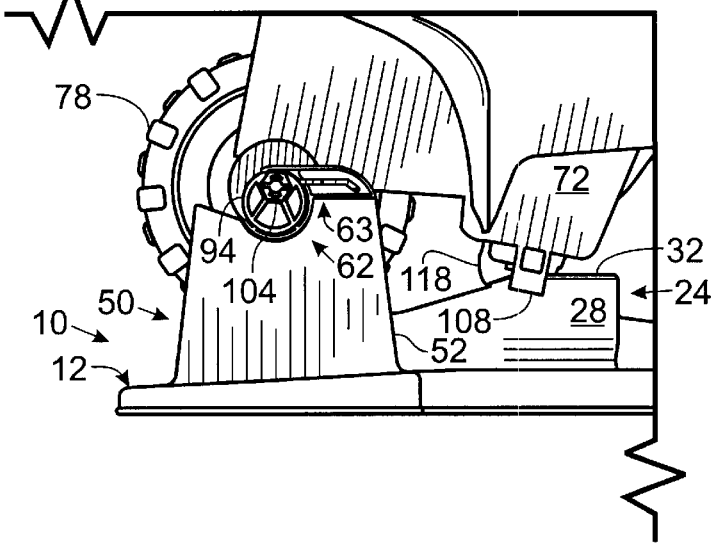

The reciprocating horizontal and vertical path of vehicle 70 on simulator 10 is shown in FIGS. 10–12. In FIG. 10, cam 94 is oriented within clip 63 so that hexagonal mount 104 is closest to base 12. In this position, the vehicle is in the central-horizontal and low-vertical extent of the defined path of the vehicle about simulator 10. In FIG. 11, the cam has rotated approximately 90° in the counter-clockwise direction from its position in FIG. 10. This is seen by looking at the relative position of the cam's hexagonal mount 104 in FIGS. 10 and 11. In this position, the vehicle is in the forward-horizontal and central-vertical extent of the path. The change in horizontal and vertical position is also seen by looking at the relative positions of the slider 108 with respect to platform 28. In FIG. 12, the cam has rotated another 90° in the counter-clockwise direction. This position represents the central-horizontal and high-vertical extent of the vehicle's reciprocating path. It should be understood that as the cam rotates another 90°, the resulting position will be the rearmost-horizontal and central-vertical extent of the defined path. Therefore, as the cams rotate about axle 80 along the path defined by the actuators and the shape of the cams, reciprocating horizontal and vertical motion is imparted to the vehicle about a defined location on the simulator. This reciprocating horizontal and vertical path simulates ground-traveling movement of the vehicle, although the vehicle is maintained in a supported position above base 12.

To use the ride simulator, the downwardly descending portion is inserted into the track in the simulator's first support structure. This step may include the substep of placing the downwardly descending portion on the landing to properly orient and balance the vehicle, then inserting portion into the track. Next, the cams are removably received into the clips on the simulator's second support structure. As the cams are inserted into the clips, the resilient shoulders deform slightly away from the base to allow the cams to be received. Once the cams are fully received and supported, the resilient shoulders return to their original positions, where they are biased to maintain the cams within the clips as the cams rotate about the vehicle's axle.

Figure 13:
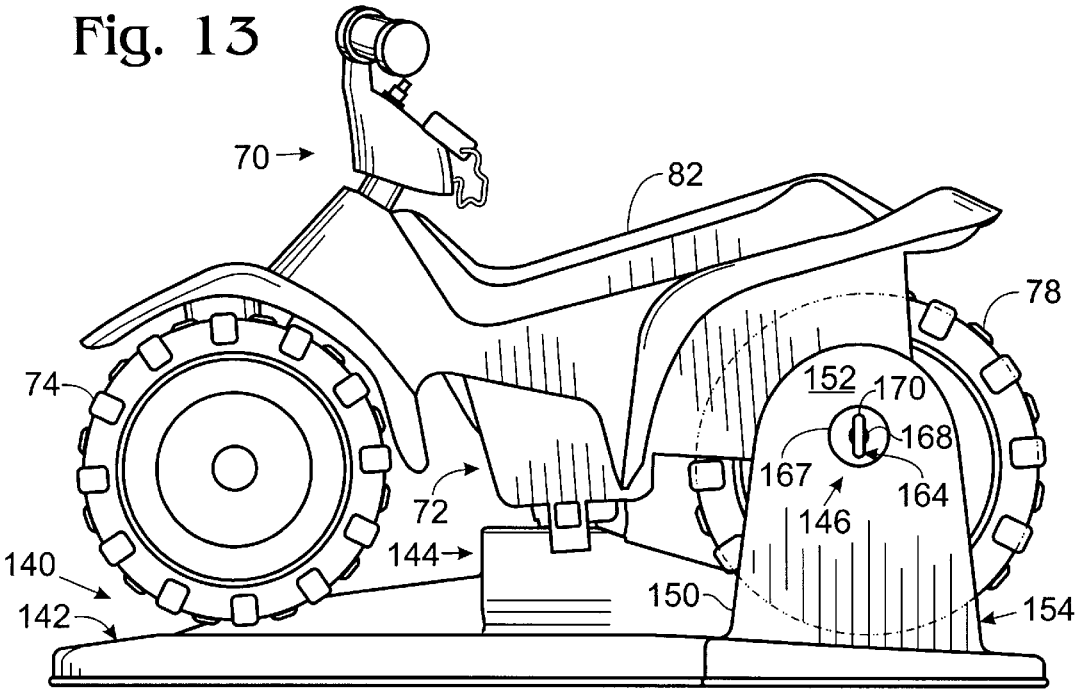
FIG. 13 is a side view of an alternate embodiment of the simulator of FIG. 1 with a children's ride-on vehicle mounted on the simulator and one of the vehicle's rear wheels removed.
Figure 14:
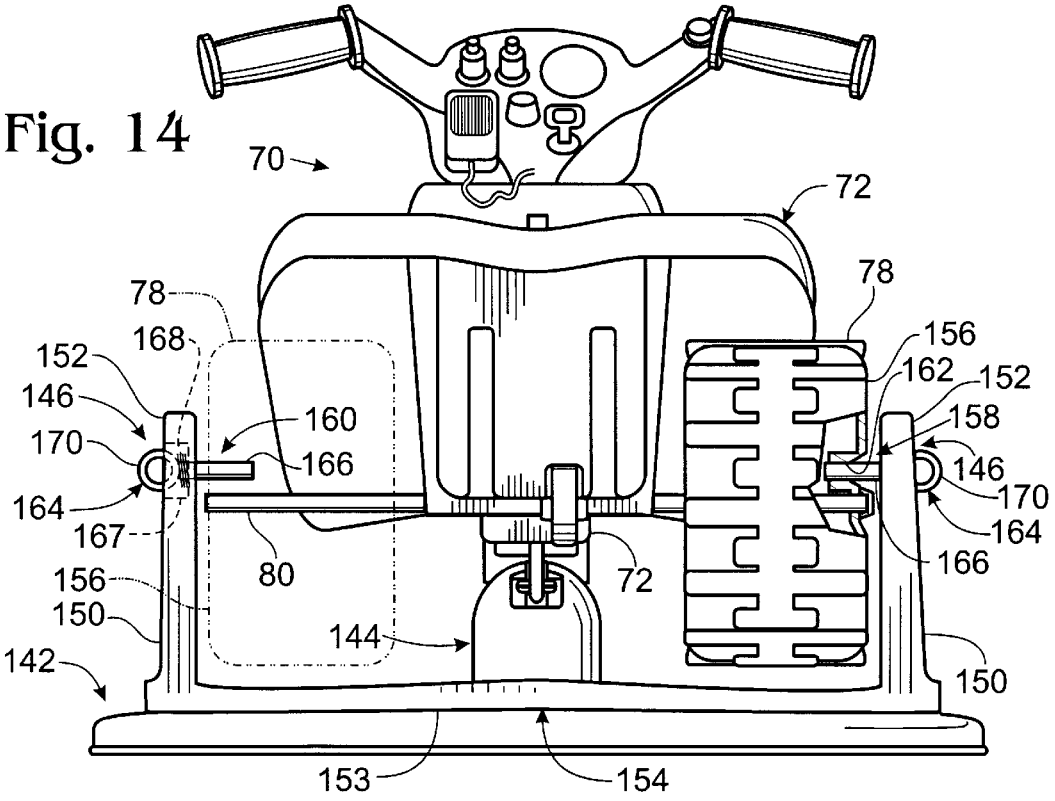
FIG. 14 is a rear view of the simulator and vehicle shown in FIG. 13.

An alternate embodiment of simulator 10 is shown in FIGS. 13 and 14 and is indicated generally at 140. Simulator 140 generally resembles simulator 110, and unless otherwise specified, has the same components and subcomponents. Simulator 10 includes a stationary base 142 and a first support structure 144 that extends upwardly from the base for removably engaging and slidably supporting at least a portion of the vehicle above base 142.

Simulator 140 further includes a pair of actuators 146 that are connected to base 112 and are each configured to be removably coupled to one of the vehicle's rear wheels 78 for effecting reciprocating horizontal and vertical motion of the vehicle about a defined location on simulator 140 when motion is imparted to the vehicle's wheels. This reciprocating motion simulates ground-traveling movement of the vehicle, although the vehicle remains fully supported above base 142. As shown, simulator 140 further includes a pair of spaced-apart mounts 150 that extend upwardly from base 142. Mounts 150 each have upper portions 152 on which one of the actuators is mounted and thereby connected to base 142. Mounts 150 are connected by an elongate rib 153, which collectively forms a second support structure 154 with the mounts. Second support structure 154 cooperates with actuators 146 to support at least a portion of the vehicle above base 142 by removably engaging the vehicle's rear wheels and thereby support the wheels and at least a portion of the vehicle above base 142.

As shown in FIG. 14, the vehicle's rear wheels 78 have opposed outer walls 156. Each outer wall includes a socket 158 that is offset from the vehicle's rear axle 80. Furthermore, each actuator 146 selectively engages one of the sockets on outer walls 156. Specifically, each actuator 146 is removably coupled to one of the sockets and causes the reciprocating horizontal and vertical motion of the vehicle when the socket revolves about the actuator as the vehicle's wheels are rotated about, or with, their axle. Preferably, each socket 158 includes a receptacle 162 that extends from outer wall 156 into rear wheel 78 and is configured to receive actuator 146. The reciprocating horizontal and vertical path in which the vehicle is moved is generally defined by the shape of the actuators and the sockets, as well as by the placement of the sockets on the outer walls of the wheels. As the distance between the sockets and the axle is increased or decreased, the horizontal and vertical extents of the vehicle's path are also increased or decreased.

As seen in FIGS. 13 and 14, each actuator 146 includes a fastening mechanism, namely, a pin 164 with a shaft 166 that extends into the receptacle on one of the vehicle's rear wheels. The pins are received into wells 167 on the mounts, and each pin includes a spring 168 that is biased to urge shafts 166 into receptacles 162 and to resist the unintentional removal of the shafts from the receptacles. Although the pins are configured to resist being unintentionally removed from the receptacles in the vehicle's rear wheels, the pin may be retracted from its resting position to allow the vehicle's wheels to be mounted on or removed from the pins. Each pin further includes a grip or handle 170 that a user can use to grasp that pin to remove it from the rear wheel's receptacle. As shown in FIGS. 13 and 14, grip 170 is a generally circular ring that extends outwardly from the exterior walls of members 150.

Other suitable embodiments of fastening mechanisms are possible and are intended to be within the scope of the invention. The fastening mechanisms should removably engage the socket on one of the vehicle's wheels and provide a moment about which the socket can revolve as the wheel rotates about its axle. For example, each fastening mechanism could include a pin that is completely removable from its corresponding mount or a cam or push rod assembly that removably engages the vehicle's rear wheels. It should be further understood that the simulator could include a single actuator that is removably coupled to both of the vehicle's rear wheels, instead of the previously described pair of actuators.

It should be understood that children's ride-on vehicles come in many different shapes and sizes. In addition, the number of motors, power supplies and wheels may vary, as well as the specific wiring and structural configuration of the vehicle. Furthermore, the previously described ride simulators could also be used with a manually powered ride-on vehicle in which the power switch motor and power source are replaced by a mechanical user-powered drive assembly, such as a series of pedals that are coupled to the vehicle's axle by a belt or gear assembly. The ride simulators can be used with any of these ride-on vehicles to simulate ground-traveling movement of the vehicle by cooperating with the vehicle's power supply to cause reciprocating horizontal and vertical motion of the vehicle about a defined location on the simulator.

As discussed, the vehicle is removably mounted on the simulator. This enables the vehicle to be used either with the simulator or independently of the simulator. This is particularly useful when children with different ages, sizes or experiences wish to play with the vehicle. In addition, parents do not have to purchase multiple vehicles. Instead, older children can use the ride-on vehicle either with the simulator or independently of the simulator. Younger children, on the other hand, can use the vehicle mounted on the simulator until they become experienced at controlling and steering the vehicle. After that time, they can selectively use the vehicle either with or without the simulator.

While the preferred embodiments of the invention have been described, it should be obvious that variations and modifications thereto are possible without departing from the spirit and scope of the invention.

I claim:

1. A ride simulator for use with a children's ride-on vehicle having a drive assembly including a first wheel that is mounted on an axle and is adapted to be coupled to an actuator, the simulator comprising:

a stationary base; and a mechanism for removably securing to the vehicle's drive assembly, the mechanism including a first actuator adapted to be removably coupled to the first wheel for effecting reciprocating horizontal and vertical motion of the vehicle with respect to the simulator when motion is imparted to the vehicle's wheel, thereby simulating ground-traveling movement of the vehicle.

2. The simulator of claim 1, wherein the simulator is adapted for use with a children's ride-on vehicle having a second wheel mounted on the axle, wherein the mechanism further includes a second actuator, and further wherein the first and the second actuators are each configured to be removably coupled to the first and second wheels, respectively, for supporting the wheels and at least a portion of the vehicle above the base and for effecting horizontal and vertical motion of the vehicle with respect to the simulator when the vehicle's wheels are driven with the axle, thereby simulating ground-traveling movement of the vehicle.

3. The simulator of claim 2, wherein the mechanism is adapted to be removably secured to the vehicle's wheels without requiring disassembly of any portion of the vehicle or the simulator.

4. The simulator of claim 2, wherein the simulator includes a support structure extending upwardly from the base and having upper portions on which the actuators are mounted to support at least a portion of the vehicle above the base when the first and the second wheels are engaged by the first and the second actuators.

5. The simulator of claim 4, further including another support structure extending upwardly from the base to removably engage and slidably support at least a portion of the vehicle above the base.

6. The simulator of claim 5, wherein the support structures cooperate to support the entire vehicle above the base.

7. The simulator of claim 2, in combination with a children's ride-on vehicle having first and second wheels mounted on an axle, wherein the first and the second wheels each include a side wall with a socket, and wherein the first and the second actuators each include a fastener for selectively engaging a corresponding one of the sockets on the side walls.

8. The simulator of claim 7, wherein the sockets are offset from the axle.

9. The simulator of claim 7, wherein the side walls are outer side walls of the wheels.

10. The simulator of claim 7, wherein each of the sockets includes a receptacle adapted to receive a corresponding one of the fasteners.

11. The simulator of claim 10, wherein each of the receptacles includes a recess into which at least a portion of the fastener is selectively inserted.

12. The simulator of claim 3, wherein each of the fasteners includes a pin adapted to be received within a corresponding one of the sockets to support the wheel and at least a portion of the vehicle above the base and to cause the reciprocating horizontal and vertical motion of the vehicle about the pin when rotational motion is imparted to the vehicle's wheels, thereby simulating ground-traveling motion of the vehicle.

13. The simulator of claim 12, wherein each of the pins is selectively slidable between a retracted position in which the pin is free from engagement with the sockets and an engaged position in which the pin engages a corresponding one of the sockets.

14. The simulator of claim 13, wherein each of the pins includes a spring that biases the pin toward the engaged position.

15. A children's amusement device, comprising the combination of:

an independently operable children's ride-on vehicle having a motorized drive assembly including an axle and at least one wheel mounted on the axle; and a ride simulator adapted for use with the vehicle, the simulator comprising:

a stationary base; and a mechanism adapted to be removably secured to the vehicle's drive assembly, wherein the mechanism includes a first actuator adapted to be removably coupled to at least one of the vehicle's wheels for effecting reciprocating horizontal and vertical motion of the vehicle with respect to the simulator when rotational motion is imparted to the wheel to which the actuator is coupled, thereby simulating ground-traveling movement of the vehicle.

16. The device of claim 15, wherein the simulator is adapted to be removably coupled to the vehicle without requiring disassembly of any portion of the vehicle or the simulator.

17. The device of claim 15, wherein the wheel to which the actuator is removably coupled includes a receptacle, and the actuator includes a fastener adapted to selectively engage the receptacle to support the wheel and at least a portion of the vehicle above the base and to cause the reciprocating horizontal and vertical motion of the vehicle about the fastener when rotational motion is imparted to the vehicle's wheels, thereby simulating ground-traveling motion of the vehicle.

18. The device of claim 17, wherein the fastener includes a pin adapted to be at least partially received within the receptacle.

19. The device of claim 18, wherein the pin is selectively slidable between a retracted position in which the pin is free from engagement with the receptacle and an engaged position in which the pin is at least partially received within the receptacle.

20. The device of claim 19, wherein the pin includes a spring that biases the pin toward the engaged position.

21. The device of claim 17, wherein the wheel to which the fastener is selectively coupled includes a side wall from which the receptacle extends.

22. The device of claim 21, wherein the side wall is an outer side wall of the wheel.

23. The device of claim 15, wherein the base further includes a support structure extending from the base to removably engage and slidably support at least a portion of the vehicle above the base.

24. The device of claim 23, wherein the support structure includes a platform that engages and slidably supports at least a portion of the vehicle above the base, and the vehicle further includes a slider that is configured to engage and slide along the platform.

25. The device of claim 24, wherein the platform includes a top portion that defines an elongate slot and a slide plane beneath the slot; the top portion, slot and slide plane defining a track into which at least a portion of the vehicle is slidably received.

26. The device of claim 23, wherein the base includes a second support structure extending upwardly from the base and having an upper portion to which the actuator is mounted.

27. The device of claim 26, wherein the support structures are adapted to support the entire vehicle above the base.

28. A method for simulating ground-traveling movement of an independently operable children's ride-on vehicle having at least one driven wheel mounted on an axle, the method comprising:

providing an independently operable children's ride-on vehicle having at least one wheel mounted on an axle and including a receptacle, and a ride simulator that includes a stationary base with an actuator adapted to be removably coupled to the receptacle;

coupling the actuator to the receptacle to support the wheel and at least a portion of the vehicle above the base;

imparting a rotational velocity to the vehicle's axle to cause reciprocating horizontal and vertical motion of the vehicle as the wheel rotates with the axle, thereby simulating ground-traveling movement of the vehicle.

29. The method of claim 28, wherein prior to the imparting step, the method comprises slidably engaging at least a portion of the vehicle with a first support structure on the base.

* * * * *